US005657713A

United States Patent [19]

Rowlett

[11] Patent Number: 5,657,713

[45] Date of Patent: Aug. 19, 1997

[54] TRI-MODAL MULTI-CANOE BOATING SYSTEM

[76] Inventor: James W. Rowlett, 576 Grand Cru, Traverse City, Mich. 49686

[21] Appl. No.: 516,822

[22] Filed: Aug. 18, 1995

[51] Int. Cl.[6] ..... B63B 1/10

[52] U.S. Cl. ..... 114/61; 114/39.1; 114/347

[58] Field of Search ..... 114/347, 61, 39.1

[56] References Cited

U.S. PATENT DOCUMENTS

| | | | |
|---|---|---|---|
| 2,712,293 | 7/1955 | O'Higgins | 114/61 |
| 3,593,684 | 7/1971 | Cogliano | 114/61 |
| 3,777,690 | 12/1973 | Garber | 114/39.1 |
| 3,785,317 | 1/1974 | Currey | 114/61 |
| 3,796,175 | 3/1974 | Ford, Jr. et al. | 114/61 |
| 3,883,909 | 5/1975 | Fisher et al. | 114/61 |
| 3,986,219 | 10/1976 | Michowski | 114/61 |
| 4,136,414 | 1/1979 | Popkin | 114/61 |
| 4,621,587 | 11/1986 | Pool | 114/61 |
| 4,641,594 | 2/1987 | Birkett | 114/43 |
| 4,807,551 | 2/1989 | Ace | 114/347 X |
| 4,862,818 | 9/1989 | Sullivan | 114/347 X |
| 5,189,974 | 3/1993 | Masters | 114/61 |

FOREIGN PATENT DOCUMENTS

| | | |
|---|---|---|
| 8600537 | 3/1986 | Netherlands . |

*Primary Examiner*—Sherman Basinger
*Attorney, Agent, or Firm*—Patula & Associates

[57] ABSTRACT

A system for adapting an open-hulled canoe to multiple modes of operation by connecting it in parallel alignment with a second open-hulled boat using bow and stern connecting members, a rigid fore cross member which spans and is releasably affixed to the fore thwart of each boat, a rigid aft cross member which spans and is releasably affixed to the aft thwart of each boat, an aft mount releasably affixed to the aft inner gunwales of each boat and adapted to carry a tiller and rudder for sailing mode of operation and a power motor for motoring mode of operation, a keel member pivotably and releasably connected to depend amidships from one of the boats and a mast stop and mast for supporting a sail releasably connected to the fore and aft cross members.

22 Claims, 5 Drawing Sheets

Fig 16
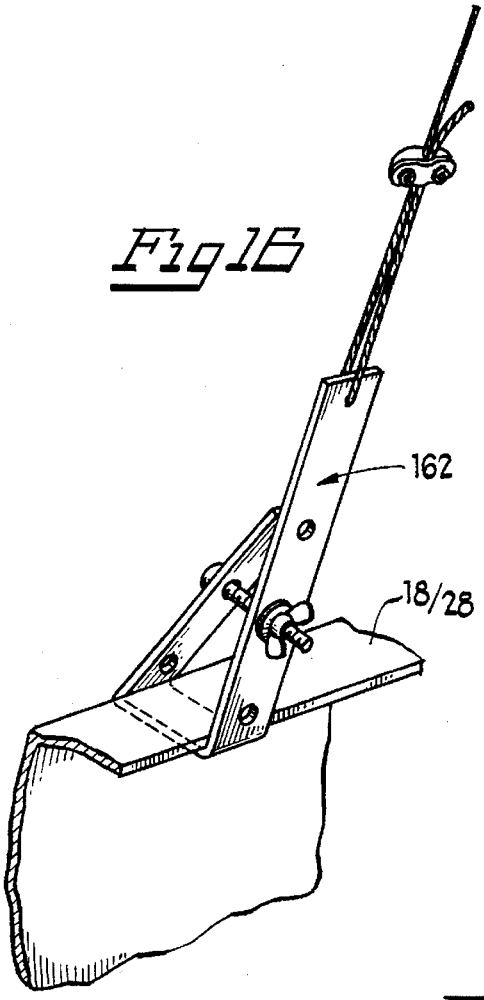
Fig 17
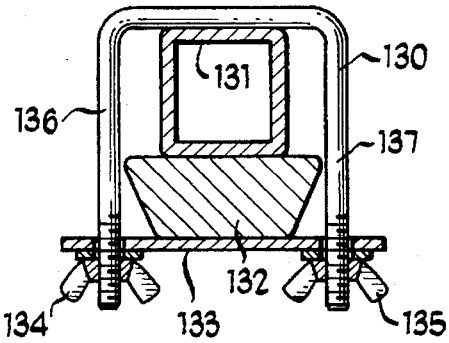
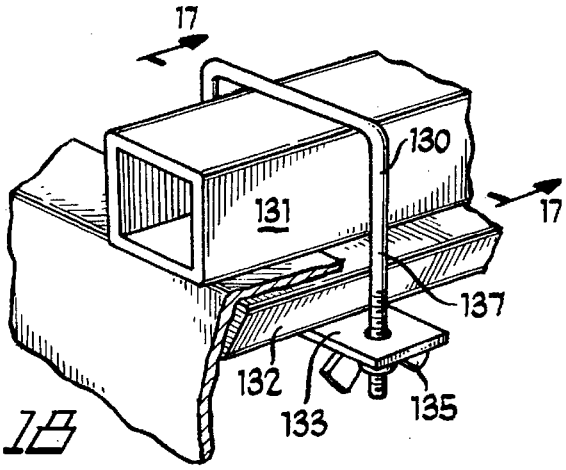
Fig 18
Fig 19
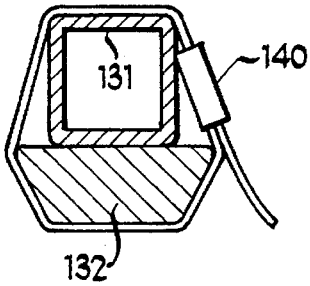
Fig 20
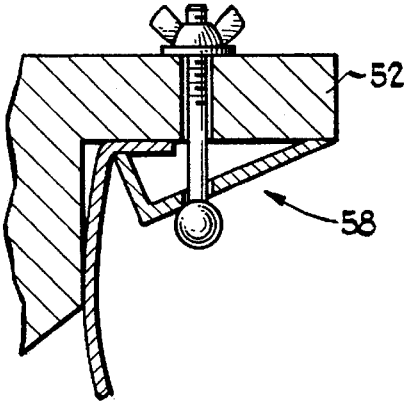

TRI-MODAL MULTI-CANOE BOATING SYSTEM

This invention relates to means for converting boats to a variety of operation modes and, more particularly, for converting open-hulled boats such as canoes to double-hulled vessels for paddling, sailing and/or power propulsion.

BACKGROUND OF THE INVENTION

The sport, industry and recreation of boating have given rise to a variety of modes of boating operations. These naturally vary with the interests and skill of the boater and the waterway involved. Boating enthusiasts who wish to navigate the likes of rivers and streams have often found that paddle propelled boats such as canoes or kayaks are pleasurable, challenging and suited for these bodies of water. However, the versatility of these vessels is limited given that they are not adapted for sailing or power propulsion.

Conversion of an open-hulled paddle operated boat to a mode of propulsion operation other than paddling or other than single hulled paddling has previously been attempted but in limited ways. For example, in U.S. Pat. No. 4,641,594 to Birkett, a kit is disclosed for converting a single canoe to a sailboat using a rectangular frame with a front crossbar for receiving a mast and a rear crossbar for supporting a seat. This kit is also configured to be capable of separate use as an iceboat independently of the canoe, with the frame having a rear ice runner supported by the rear crossbar and front ice runners supported by the front cross bar if desired. The problem with this design is that the canoe-turned-sailboat would be most unstable as a sailboat given that it is without keel means or rudder. Although speed could be enhanced by hoisting this conversion kit sail, the means of controlling such speed and direction of the converted canoe would be very limited.

Another conversion construction is disclosed in U.S. Pat. No. 4,621,587 to Pool. This invention teaches the construction of a catamaran assembly from two kayak-type canoe hulls joined together by a trampoline frame mounted to the pair of hulls. This construction depends upon kayak-type or closed hulled canoes and the use of a trampoline frame mounted to the fore and aft hull coverings of each boat. It is not designed to function on an open-hulled canoe and so its application is different from that of the subject invention. It discloses no motor driven mode of operation, as does the subject invention. Also, the trampoline frame to which a deck is laced is cumbersome to transport and bulky to store when not in use as the catamaran deck.

Dutch Patent No. 8600537 teaches a catamaran constructed from kayak-type canoes with a trampoline-type deck used to frame the hulls in parallel alignment by connecting the trampoline frame to the fore and aft hull coverings. This invention presents limitations similar to the Pool patent.

Other designs have been attempted to vary boat construction and mode of operation. In U.S. Pat. No. 5,189,974, for example, a catamaran kayak is disclosed which comprises a flexible coupling formed on the fore and aft kayak hulls for keeping a plurality of kayaks in parallel alignment. Although this provides enhanced stability, such as would be useful for whitewater boating, it teaches no sailing or power driven means of propulsion. It is designed to be used for closed hulled vessels.

Other catamaran construction designs include U.S. Pat. Nos. 3,986,219 and 3,883,909. In U.S. Pat. No. 3,986,219, a collapsible catamaran is disclosed which teaches the construction of tubular members into a rectangular frame joined at the corners by union elbows, the frame then being joined to the pontoon members of the catamaran by connecting it to an upwardly extending tubular member of each pontoon. Although this invention is advantageous for its collapsibility, it affords no other versatility for alternate modes of operation such as independent pontoon paddling, sailing or power propulsion. U.S. Pat. No. 3,883,909 also provides a disassemblable catamaran design, but without flexibility as to modes of operation. U.S. Pat. No. 3,796,175 also teaches a catamaran construction from two hulls, but the hulls disclosed likewise are not intended for alternate boating uses, as is the objective of the subject invention.

In U.S. Pat. No. 3,777,690, inventor Garber teaches a sailing outrigger for converting a small boat like a canoe into a sailboat by affixing a sailing outrigger to a single canoe. The outrigger is intended to be attached to the boat at either side, port or starboard. An elongated float stabilizes the canoe and supports the mainsail mast. Two cross arms, fore and aft, rest on and are removably clamped to the gunwales of the canoe to support the sailing outrigger. This invention does provide the advantage of versatility by allowing conversion of a single canoe into a sailing mode of operation but, as with U.S. Pat. No. 4,621,587, the configuration involves a cumbersome feature not easily transported by the individual canoer. In the case of the '690 patent this cumbersome feature is the elongated float. In the case of the '587 patent the cumbersome feature is the trampoline. Neither invention teaches a power driven propulsion feature.

It therefore is an object of this invention to provide a system for rendering a boat more versatile by converting two open-hulled independently operable and paddle-propelled boats into a combined side by side double-hulled boat capable of being propelled by paddling, sailing and/or motoring.

Another object of the present invention is to provide such open-hulled boat conversion system in a manner which is simple, easily transportable, low-cost, and safe to employ.

Another object of the present invention is to provide an open-hulled boat conversion system for disassembly combining two independent boats into two parallel joined boats capable of multiple modes of operation, including paddling, sailing and outboard motoring.

Still another object of the present invention is to provide an open-hulled boat conversion system for combining two independent boat into a catamaran-type configuration with connection means which are easy to assemble and disassemble, lightweight, and relatively compact and easy to transport when not in use, and sturdy, reliable and responsive when in use.

Yet another object of the present invention is to provide modes of operation for an open-hulled canoe other than paddling the single canoe which are safe, stable in a wide variety of bodies of water, and improved for effectively and aggressively navigating the vessel as converted.

SUMMARY OF THE INVENTION

The present invention is a system for adapting an open-hulled boat to alternate modes of operation by connecting it in parallel alignment with a second open-hulled boat using bow and stern connecting members, a rigid fore cross member which spans both boats, which boats are equipped with fore and aft thwarts, which fore cross member is releasably connected to the fore thwart of each boat using conventional connection means, a rigid aft cross member which spans both boats and is releasably connected to the aft thwart of each boat using conventional connection means, a centerboard pivotably depended amidships from a centerboard mount releasably connected to the gunwales of one boat, an aft motor/rudder mount releasably connected to the aft inside gunwales of each boat and depended therefrom between the boats, onto which mount the rudder and tiller are releasably affixed when sailing mode is desired and to which a conventional motor is releasably affixed when power propulsion is desired, a main sail mast stepped into a mast step affixed to the fore cross member between hulls of the boats, boom, main sail, jib and related lines and line cleats for operating the vessel in sailing mode.

These and numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings wherein:

FIG. 16 is a perspective view of an alternative shroud-to-gunwale connection.

FIG. 17 is a cross-sectional view taken along line 17—17 of FIG. 18, of the conventional U-bolt attachment of cross member to thwart.

FIG. 18 is a partial perspective view of cross member to thwart U-bolt connection.

FIG. 19 is a cross-sectional view of a cross member to thwart sports clamp type connection.

FIG. 20 is a partial cross-sectional view of the motor/rudder mount attached to the aft inner gunwale.

DETAILED DESCRIPTION OF THE DRAWINGS

Figure 1:
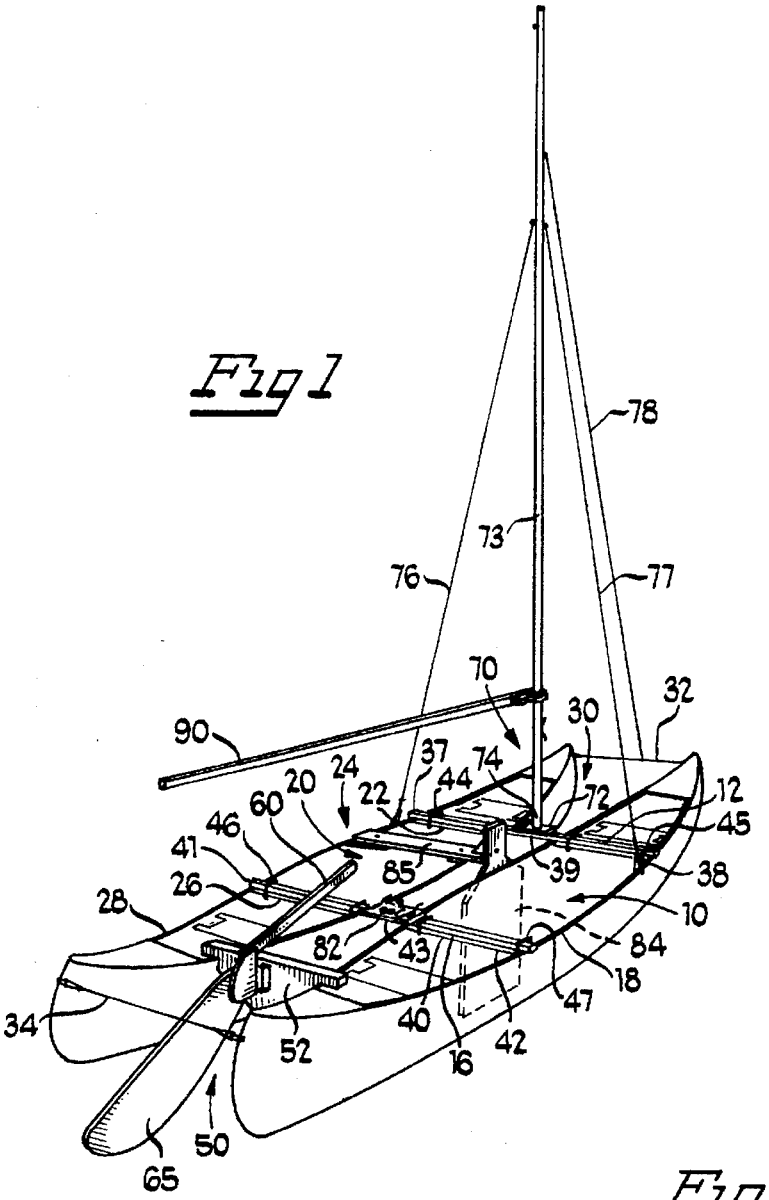
FIG. 1 is a perspective view of the open-hulled boat conversion system of the present invention depicting canoe-type boats in this the preferred embodiment of the invention.

While the invention is susceptible of embodiment in many different forms, there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

Referring now to FIG. 1, the conversion system is shown in perspective view depicting open-hulled boat 10 connected in parallel alignment with open-hulled boat 20. In the preferred embodiment of the invention, open-hulled boats 10 and 20 are canoes, affording enhanced maneuverability which is particularly important when utilizing the sailing mode of operation which the present invention avails. However, alternate open-hulled boats may also be converted using the conversion system of the present invention. Boats 10 and 20 are further defined by fore thwarts 12 and 22 respectively and aft thwarts 16 and 26 respectively. When brought in parallel side-by-side alignment, boat 10 is further defined by side deck 18, and boat 20 is further defined by side deck 28.

Also shown in FIG. 1 are connect means 30 comprised of bow connect member 32 and stern connect member 34 which in the preferred embodiment of the invention are cables or, as an alternative, rods, releasably attached to the bow and stern, respectively, of boats 10 and 20 to rigidly align boats 10 and 20 in parallel and with consistent spacing. Connect means 30 are further comprised of fore cross member 36 having port end 37, starboard end 38 and middle portion 39, and aft cross member 40 having port end 41, starboard end 42 and middle portion 43. FIG. 1 shows the conversion system of the present invention having affixed the boats 10 and 20 in parallel alignment using connect means 30, with fore cross member 36 releasably connected to fore thwarts 12 and 22 of boats 10 and 20 respectively using thwart connects 44 and 45 and with aft cross member 40 releasably connected to aft thwarts 16 and 26 of boats 10 and 20 respectively using thwart connects 46 and 47. In the preferred embodiment of the invention, boats 10 and 20 are closely spaced, preferably six to eighteen inches, and optimally twelve inches, between inner gunwale amidships, to assure that best performance and safety of the invention.

FIG. 1 also shows the conversion system of the present invention in sailing mode of operation, with sailing means 50 comprised of motor/rudder mount 52 releasably connected to and between boats 10 and 20 in aft position, with rudder 65 and tiller 60 mounted to said mount 52. Sailing means 50 is further comprised of sailing mount means 70 having a mast step 72 affixed between hulls to fore cross member 36, mast 73 having mast foot 74 stepped into mast step 72 for releasably mounting said mast 73. Port shroud 76 secures mast 73 to side deck 28 of boat 20 and starboard shroud 77 secures mast 73 to side deck 18 of boat 10. As illustrated in FIG. 10, sailing means 50 is further comprised of boom 90, main sail 100 hoisted on mast 73, jib sail 110 shown in FIG. 10 hoisted on mast 73, running on shackles from forestay 78 connected from said mast 73 to bow connect member 32, and illustrated in FIG. 14, jib sheet cleats 79 and main sheet jam cleat 80 mounted on control plate 82 affixed to the middle portion 43 of aft cross member 40, centerboard 84 pivotably depended from centerboard mount 85 (FIG. 13) having midships end 86 and exterior end 87 and releasably connected to gunwales just forward of center 24 of boat 20 using conventional connect means 89, also depicted in FIGS. 9, 10 and 13.

Figure 2:
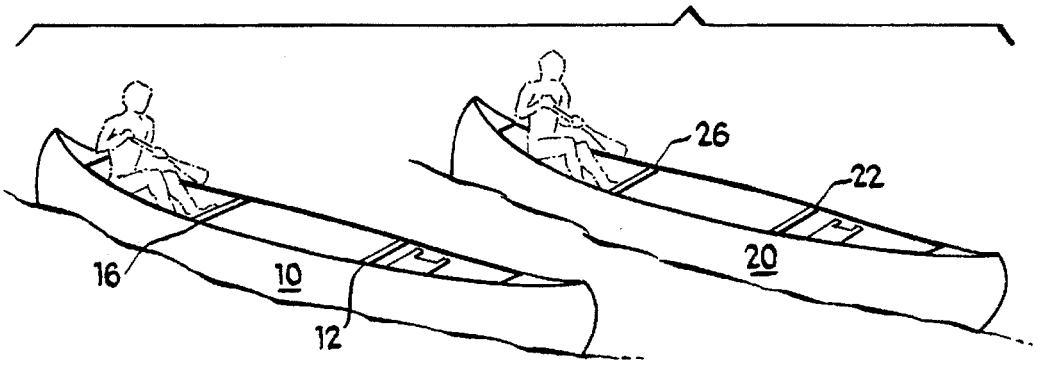
FIG. 2 is a perspective view of the two canoes of the preferred embodiment of the present invention in separate, independent paddling modes of operation.

FIG. 2 is a perspective view of independent paddling operation of boats 10 and 20 before adaptation of the conversion system of the present invention.

Figure 3:
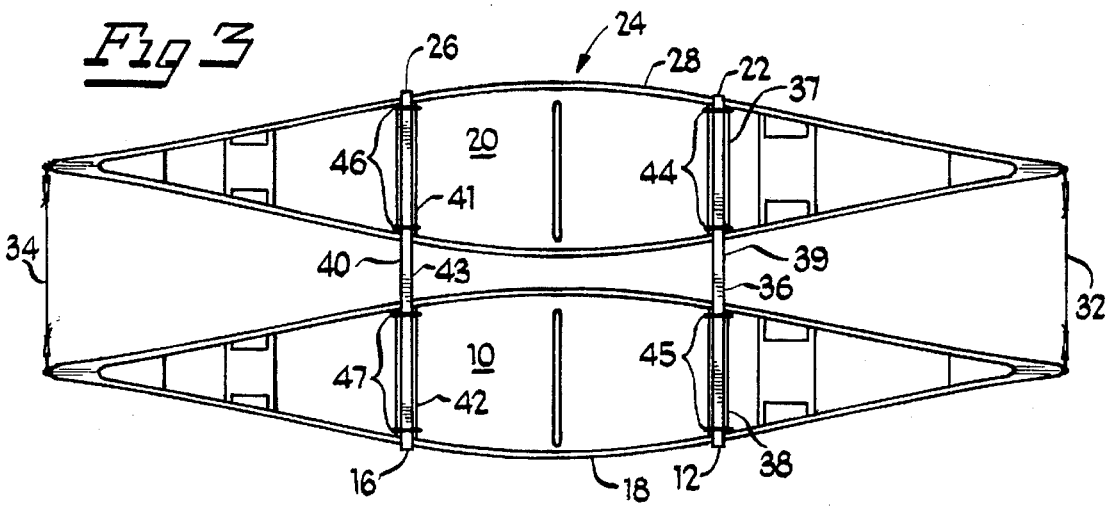
FIG. 3 is a top plan view of the canoes connected side by side for double-hulled paddling.

FIG. 3 is a top plan view of boats 10 and 20 brought into parallel alignment and connected side by side. Bow connect member 32 joins the bow of boats 10 and 20, and stern connect member 34 joins the stern of boats 10 and 20. Fore cross member 36 is shown releasably affixed to fore thwarts 12 and 22 of boats 10 and 20 respectively using thwart connects 44 at port end 37 and inner gunwale near side deck 28 of boat 20 and thwart connects 45 at starboard end 38 and inner gunwale near side deck 18 of boat 10. Aft cross member 40 is shown releasably affixed to aft thwarts 16 and 26 of boats 10 and 20 respectively using thwart connects 46 at port end 41 and inner gunwale near side deck 28 of boat 20 and thwart connects 47 at starboard end 42, and inner gunwale near side deck 18 of boat 10. As can be seen, thwart connects 44, 45, 46 and 47 fasten cross members 36 and 40 near the inner gunwales as well as the side decks of each boat.

Figure 4:
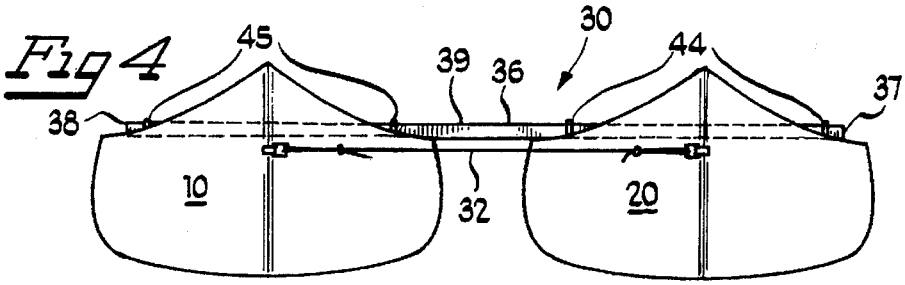
FIG. 4 is a front elevational view of the canoes of the preferred embodiment of the present invention connected in parallel alignment without sailing or motor propulsion means attached.

FIG. 4 is a front or bow end elevational view of boats 10 and 20 connected in double-hulled alignment by connect means 30 of the present invention.

Figure 5:
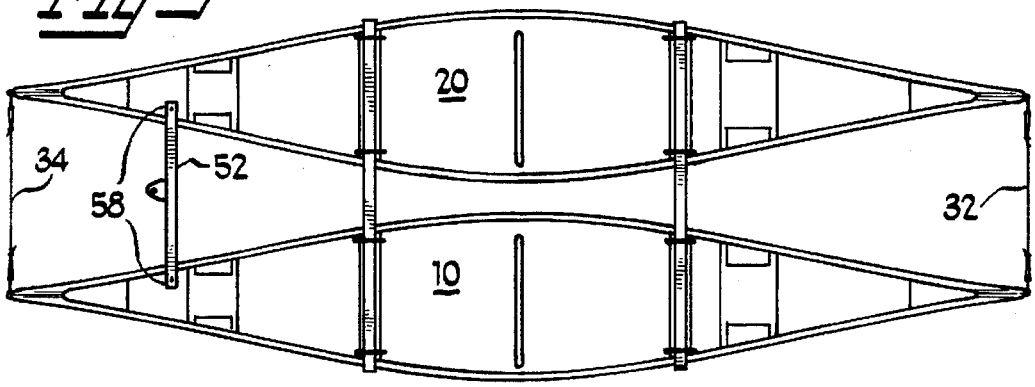
FIG. 5 is a top plan view showing the canoes connected in parallel alignment with motor/rudder mount affixed.
Figure 6:
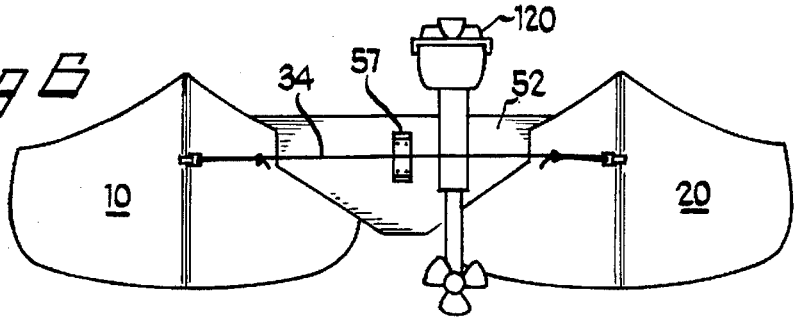
FIG. 6 is a rear elevational view showing the double-hulled configuration with motor/rudder mount and motor affixed.
Figure 7:
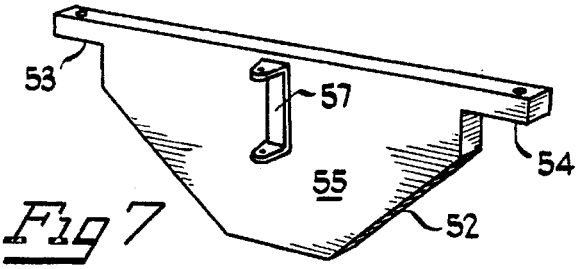
FIG. 7 is a rear perspective view of the motor/rudder mount.
Figure 8:
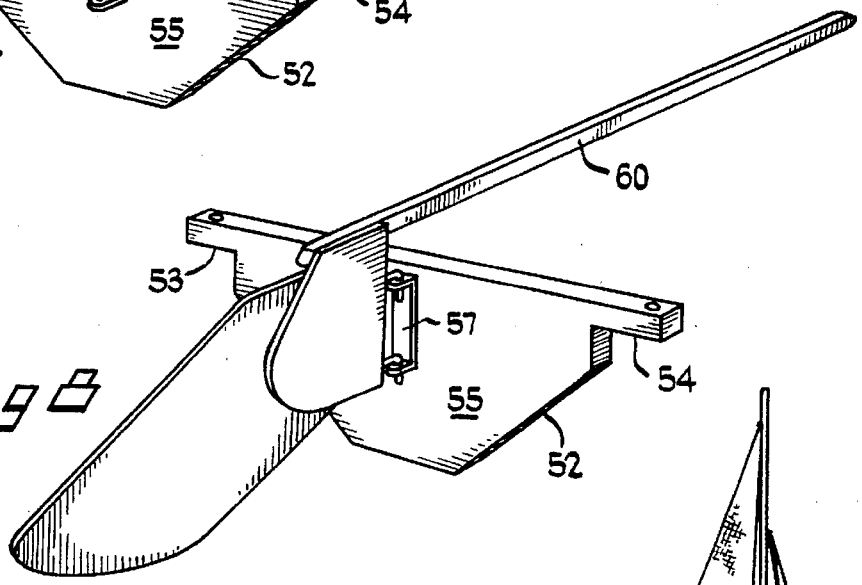
FIG. 8 is a rear perspective view of the rudder and tiller mounted to the motor/rudder mount.

FIG. 5 is a top plan view of the present invention showing two open-hulled boats 10 and 20 connected in side-by-side alignment, also depicting motor/rudder mount 52 releasably affixed to inside gunwales of boats 10 and 20 near the stern. Mount 52 is affixed to the inner aft gunwale of boat 10 and boat 20 using mount connect means 58, which is depicted more clearly in FIG. 20. As seen in FIGS. 7 and 8, mount 52 is further defined by port flange 53 which rests on aft inner gunwale of boat 20, starboard flange 54 which rests on aft inner gunwale of boat 10, and mount face 55 on which bracket 57 is affixed for mounting rudder 65 when in sailing mode of operation as show in FIG. 6, motor 120, is mounted on mount 52 next to bracket 57 when power propulsion mode of operation is desired. A standard battery or gasoline powered, relatively low horsepower (3 hp) outboard motor proves to be quite suitable for the average fishing and light power drive operations. Connect means 30 and motor/rudder mount 52 can be stored in zippered, canvas bags for ease of handling and transport.

FIGS. 8 through 16 detail the sailing mode of operation of the present invention utilizing the double-hulled configuration of boats 10 and 20 connected side-by-side. FIG. 8 is a rear perspective view showing rudder 65 and tiller 60 mounted to bracket 57 of mount 52, in preparation for sailing mode of operation.

Figure 9:
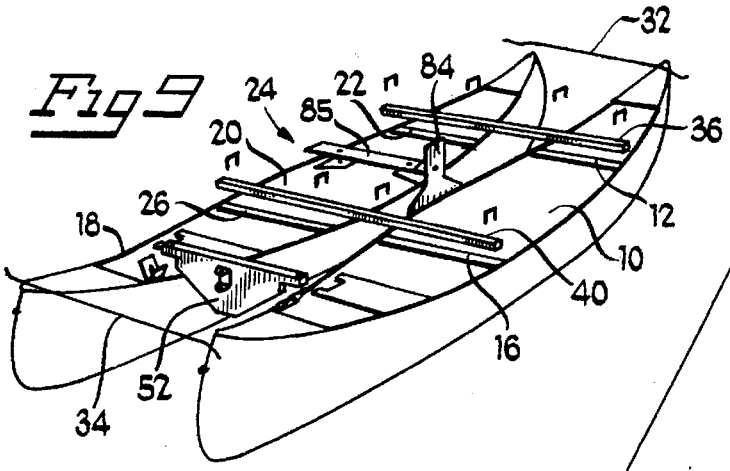
FIG. 9 is a partially exploded perspective view of the canoes in side by side alignment in preparation for being connected.
Figure 10:
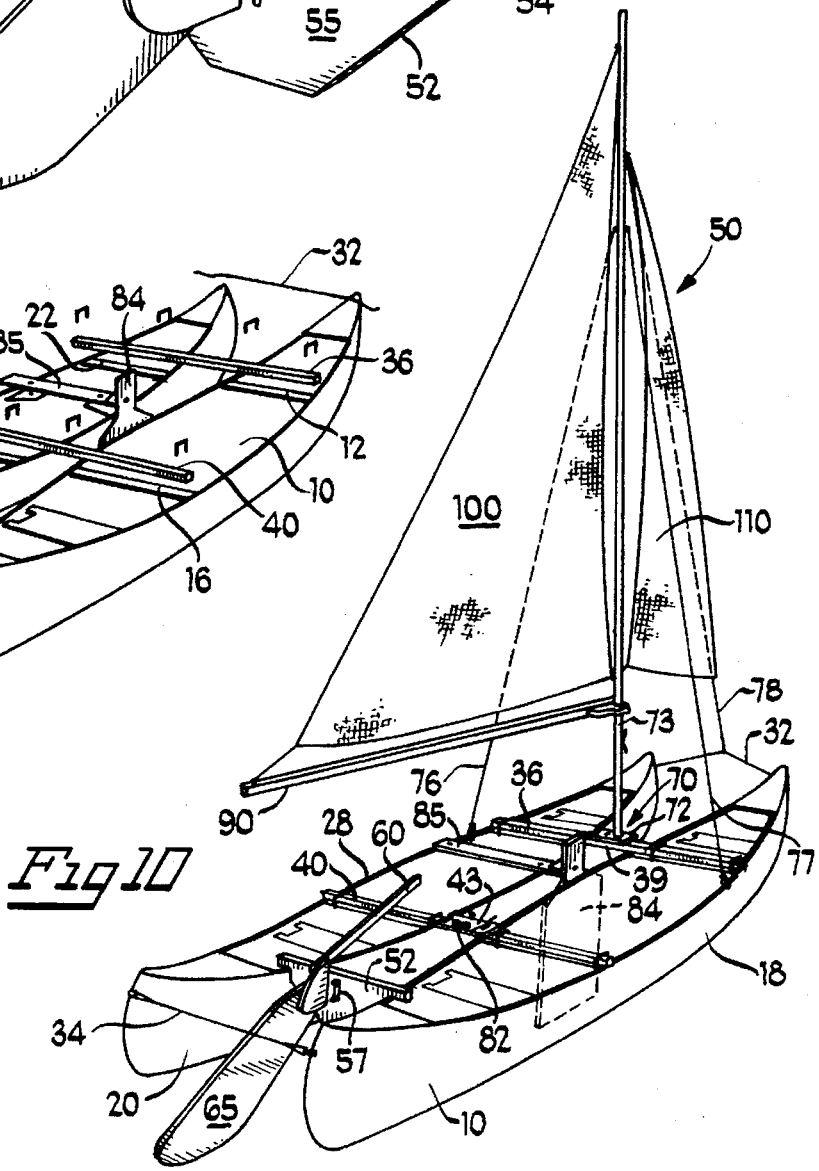
FIG. 10 is a perspective view of the doubled-hulled configuration assembled for sailing with rudder and tiller connected to the motor/rudder mount and centerboard attachment.

FIG. 9 is a partially exploded perspective view of boats 10 and 20 brought into parallel alignment, in preparation for conversion to the double-hulled use, showing bow connect member 32 to be connected to the bow of boats 10 and 20, showing stern connect member 34 to be connected to the stern of boats 10 and 20, showing fore cross member 36 to be connected to fore thwarts 12 and 22 of boats 10 and 20, aft cross member 40 to be connected to aft thwarts 16 and 26 of boats 10 and 20, as described above in relation to FIG. 1, and centerboard mount 85 to be connected to the gunwales of either canoe, on side deck 18 or 28 from which centerboard 84 is to depend preferably just forward of amidships.

Fore cross member 36 and aft cross member 40 are releasably connected to their respective thwart locations using attachment means, as depicted more clearly in FIGS. 17–19. FIG. 17 is a cross-sectional view of a U-bolt attachment of cross member (designated generally as 131) to thwart (designated generally as 132), showing the U-bolt 130 being placed over the cross member 131 which rests on top of the thwart 132 and in parallel alignment with it. A bolt plate 133 is placed under the thwart, with the bolt legs 136 and 137 threaded through bolt holes in the bolt plate and tightened into place using wing nuts 134 and 135 at the threaded end of the free bolt legs 136 and 137 under the bolt plate. U-bolt attachments are secured at port end 37 of fore cross member 36 near side deck 28 of boat 20, at starboard end 38 of fore cross member 36 near side deck 18 of boat 10, at port end 41 of aft cross member 40 near side deck 28 of boat 20, and at starboard end 42 of aft cross member 40 near side deck 18 of boat 10, as well as at the inner gunwales as shown by representation in FIGS. 17 and 18. FIG. 19 shows an alternate cross member to thwart attachment comprised of a sports clamp 140 looped around the cross member 131 and thwart 132 and tightened to secure in place.

FIG. 10 is a partial perspective view of the double-hulled assembly of the present invention in its sailing mode of operation, with sailing means 70 fully employed to convert boats 10 and 20 into the sailing mode of operation in accordance with the description above relative to FIG. 1. Tiller 60 and tip-up rudder 65 are fitted into bracket 57 on mount 52. Mast step 72 clamps by U-bolt connection to fore cross member 36 at middle portion 39 between hulls 10 and 20. Mast 73 is stepped into mast step 72 and fixed in place by clamping port shroud 76 to side deck 28 and starboard shroud 77 to side deck 18 on the outside gunwales of boats 20 and 10 respectively. Forestay 78 is snap-shackled to bow connect member 32. Jib sheet cleats 79 (FIG. 14) and main sheet jam cleat 80 (FIG. 14) mounted to control plate 82 connected to aft cross member 40 at middle portion 43 hold jib and mainsail sheets. Centerboard 84 is positioned between boat 10 and 20 just forward of amidships and depended from centerboard mount 85, fixed into place by one bolt and wing or tail nut, as depicted in FIGS. 1, 10, 12 and 13.

Figure 11:
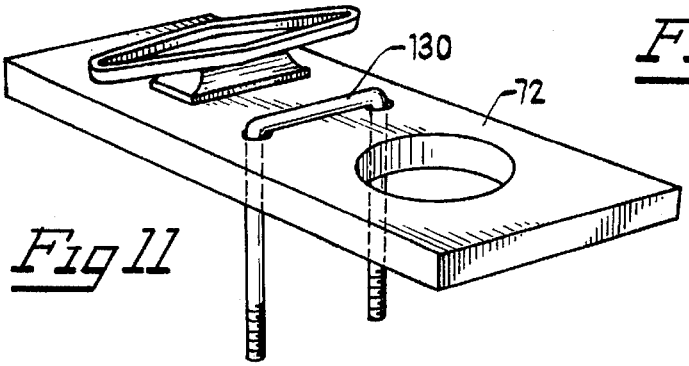
FIG. 11 is a perspective view of the mast step.

FIG. 11 further depicts mast step 72 to be connected to the middle portion 39 of fore cross member 36 using the U-bolt attachment means described above and shown in FIGS. 17 and 18.

Figure 12:
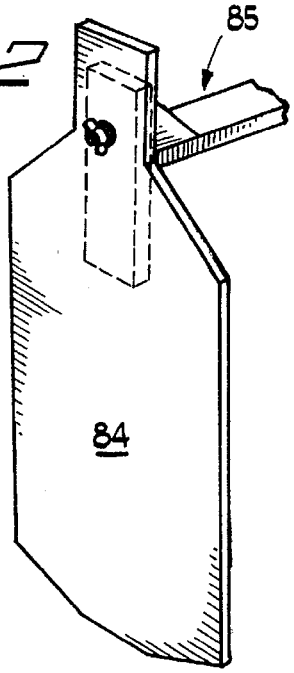
FIG. 12 is a perspective view of the centerboard.
Figure 13:
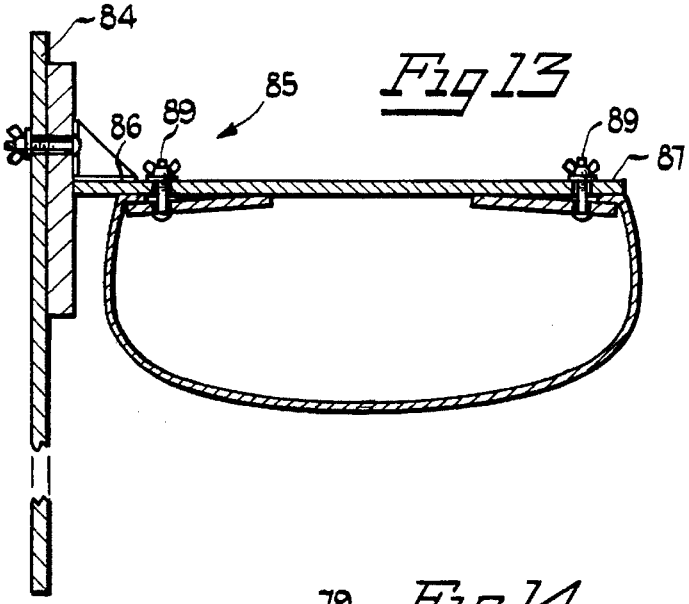
FIG. 13 is a cross-sectional view of the centerboard mount attached to the gunwales of one boat with centerboard depending amidships.
Figure 14:
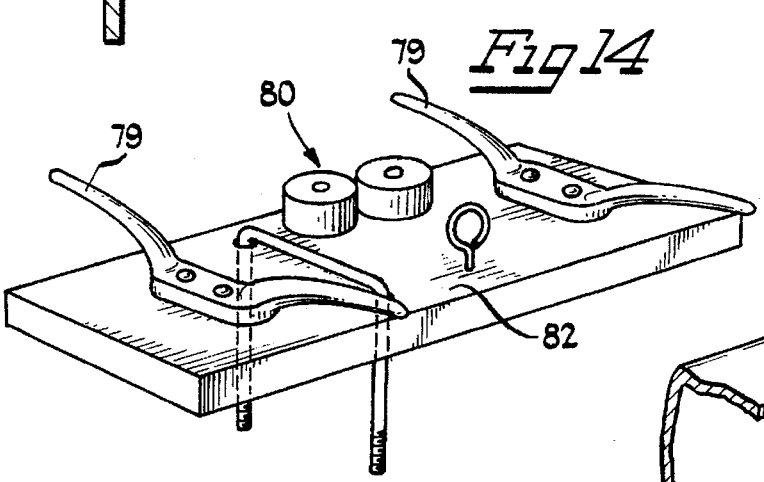
FIG. 14 is a perspective view of the sheet cleats.

FIG. 12 is a side elevational view of centerboard 84 which is pivotably depended from centerboard mount 85 as shown in FIGS. 1, 10 and 13, amidships and secured in place by bolt and wing nut fittings for use as a keel when sailing. FIG. 14 is a perspective view of the two jib sheet cleats 79 and the main sheet jam cleat 80 affixed to control plate 82 which is mounted on middle portion 43 of aft cross member 40.

Figure 15:
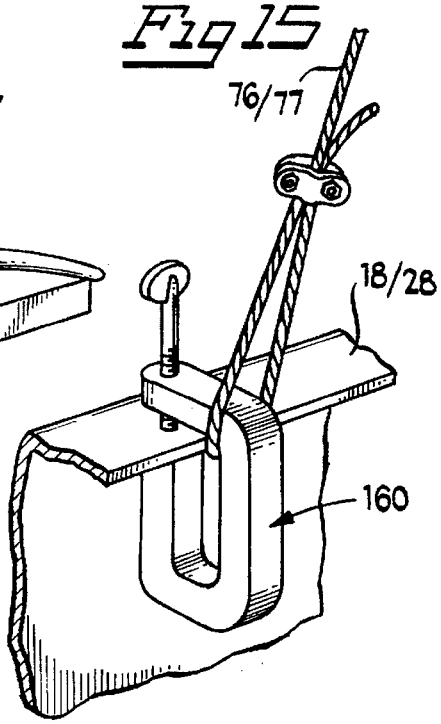
FIG. 15 is a perspective view of the shroud connected to the gunwale.

FIGS. 15 and 16 are alternate perspective views depicting shroud attachments 160 (FIG. 15) or 162 (FIG. 16) connecting either shroud 76 or 77 to the gunwales at either side decks 18 and 28.

The preferred embodiment of the invention as described above allows for quick and simple yet rigid connection of two open-hulled boats in parallel using disassemblable parts which can easily be stowed, transported, assembled and disassembled by a single person.

It is to be understood that the embodiments herein described are merely illustrative of the principles of the present invention. Various modifications may be made by those skilled in the art without departing from the spirit or scope of the claims which follow.

What I claim is:

1. A canoe conversion system for multi-modal boating operation, comprising:

two open-hulled canoes each having a bow, a stern, a fore thwart and an aft thwart;

connect means cooperatively associated with said fore and aft thwarts for disassemblably positioning said canoes in parallel alignment, said connect means including a fore cross member releasably affixed to said fore thwart of each canoe so as to extend substantially parallel to said fore thwart and an aft cross member releasably affixed to said aft thwart of each canoe so as to extend substantially parallel to said aft thwart; and multi-modal drive means for powering said canoes upon engaging said connect means.

2. The system recited in claim 1, wherein said connect means further includes a bow connect member attached to the bow of each canoe and a stern connect member attached to the stern of each canoe.

3. The system recited in claim 2, wherein said bow and stern connect members are rods.

4. The system recited in claim 2, wherein said bow and stern connect members are cables.

5. The system recited in claim 1, wherein said connect means rigidly distance said canoes apart with consistent spacing.

6. A canoe conversion system for multi-modal boating operation, comprising:

two open-hulled canoes each having a fore thwart and aft thwart;

connect means cooperatively associated with said fore and aft thwarts for disassemblably positioning said canoes in parallel alignment; and multi-modal drive means for powering said canoes upon engaging said connect means, said drive means is further defined by sailing means comprised of:

an aft mount having a port and starboard flange releasably affixed to the inner aft gunwales of said canoes, a tiller releasably connected to said aft mount and a rudder releasably connected to said aft mount;

keel means pivotably mounted depended amidships; and a mast supporting a main sail, jib and boom, said mast secured to said canoes by a port side shroud connected to port side deck, a starboard side shroud connected to starboard side deck, and a forestay.

7. The system recited in claim 6, wherein said keel means is a centerboard pivotably positioned between canoes amidships and attached to a centerboard mount releasably fastened to the gunwales of one of said canoes.

8. The system recited in claim 1, wherein said drive means is further defined by an aft mount releasably affixed to inner aft gunwales of said canoes and defining an additional connect member, said mount providing a mounting surface for a power motor and a mounting face for a rudder bracket for releasably attaching a rudder.

9. A device for converting two open-hulled canoes, each having a bow, a stern, a fore thwart and an aft thwart, into varying operative modes, said device comprising:

connect means for disassemblably joining said canoes in parallel association, said connect means is comprised of a fore cross member releasably affixed to said fore thwarts of said canoes so as to extend substantially parallel to said fore thwarts, an aft cross member releasably affixed to said aft thwarts of said canoes so as to extend substantially parallel to said aft thwarts, and a bow connect member attached to the bow of each canoe and a stern connect member attached to the stern of each canoe; and means adapted to be releasably mounted to said connect means for propelling said canoes.

10. The device recited in claim 9, wherein said connect means is further defined by U-bolt connections of said fore and aft cross members to said fore and aft thwarts of said canoes, respectively, at port and starboard side deck locations of each thwart of each canoe.

11. The device recited in claim 9, wherein said bow and stern connect members are rods.

12. The device recited in claim 9, wherein said bow and stern connect members are cables.

13. The device recited in claim 9, wherein said connect means rigidly and consistently space apart said canoes.

14. The device recited in claim 9, wherein said connect means is further defined by:

an aft mount releasably affixed to an inner aft gunwale of each canoe and having a mounting surface and a mounting face to which is affixed a bracket; and said means for propelling is further defined by:

one of a tiller-rudder releasably connected to said bracket and power motor releasably connected to said mounting surface to effect one of a sail mode and power mode operation, respectively.

15. The device recited in claim 14, wherein said means for propelling is further defined by a centerboard attached to a cross member affixed to the gunwales of one of said canoes and being pivotably positioned between the inner gunwales approximately amidships of said canoes for use as keel means; and a mast supporting a main sail, jib and boom, said mast secured to said canoes by a port shroud connected to port side deck, a starboard shroud connected to starboard side deck, and a forestay connected to a bow connect member.

16. A method for disassemblably converting two open-hulled canoes, each having a fore thwart, an aft thwart, a bow and a stern, into multi-modal use, comprising the steps of:

releasably mounting a first and second rigid cross member to said fore and aft thwarts respectively of each canoe so as to extend substantially parallel to said fore and aft thwarts using fastening means;

connecting said canoes at a predetermined equidistance via a bow connect member fastened to the bow of each canoe and a stern connect member fastened to the stern of each canoe;

releasably mounting an aft cross mount, adapted to carry one of a tiller-rudder and a power motor, to an aft inner gunwale of each canoe; and releasably mounting keel means to depend pivotably from one of said canoes amidships.

17. The method recited in claim 16 wherein a powering mode of operation is effected by the additional step of releasably mounting a power motor onto said aft cross mount.

18. The method recited in claim 16 wherein a sailing mode of operation is effected by the additional steps of releasably mounting a tiller-rudder onto said aft cross mount, affixing a mast to which a boom is attached into a mast step set on said first cross member, erecting and securing said mast as erected by connecting a port shroud to a port side deck, connecting a starboard shroud to a starboard side deck, and connecting a forestay to the bow connect member.

19. The method recited in claim 16 wherein said predetermined equidistance is six to eighteen inches.

20. A canoe conversion system for converting two open-hulled canoes, each having a bow, a stern, an inner gunwale, a fore thwart and an aft thwart, into multi-modal boating operation, said system comprising:

a plurality of cross members for disassemblably positioning said canoes in parallel alignment at a predetermined equidistance, said plurality of cross members including:

a main fore cross member fastened to said fore thwart of each canoe so as to extend substantially parallel thereto, a main aft cross member fastened to said aft thwart of each canoe so as to extend substantially parallel thereto, a bow connect member fastened to said bow of each canoe, a stern connect member fastened to said stern of each canoe, and an aft cross mount fastened to said inner gunwale of each canoe; and means attachable to at least one of said plurality of cross members for effecting said boating operation.

21. The system of claim 20, wherein said means for effecting includes:

a mast step attached to said main fore cross member amidships;

a tiller/rudder mounted to said aft cross mount;

a keel means pivotably mounted amidships; and a mast removably mounted in said mast step and secured to the canoes by a port side shroud, a starboard side shroud and a forestay.

22. The system of claim 20, wherein said means for effecting includes a motor releasably mounted to said aft cross mount.

* * * * *

UNITED STATES PATENT AND TRADEMARK OFFICE

CERTIFICATE OF CORRECTION

PATENT NO : 5,657,713

DATED : August 19, 1997

INVENTOR(S) : Rowlett

It is certified that error appears in the above-identified patent and that said Letters Patent is hereby corrected as shown below:

In line 12 of the Abstract, the word "stop" should read - -step- -.

Signed and Sealed this

Seventeenth Day of February, 1998

Bruce Lehman

*Attest:*

BRUCE LEHMAN

*Attesting Officer*

*Commissioner of Patents and Trademarks*